US007211160B2

(12) United States Patent
Hasegawa et al.

(10) Patent No.: US 7,211,160 B2
(45) Date of Patent: May 1, 2007

(54) ALUMINUM ALLOY PIPING MATERIAL FOR AUTOMOTIVE TUBES HAVING EXCELLENT CORROSION RESISTANCE AND FORMABILITY, AND METHOD OF MANUFACTURING SAME

(75) Inventors: Yoshiharu Hasegawa, Obu (JP); Haruhiko Miyachi, Okazaki (JP); Takahiro Koyama, Nagoya (JP); Yoshifusa Shoji, Nagoya (JP)

(73) Assignees: Denso Corporation, Kariya, Aichi (JP); Sumitomo Light Metal Industries, Ltd., Tokyo (JP)

( * ) Notice: Subject to any disclaimer, the term of this patent is extended or adjusted under 35 U.S.C. 154(b) by 0 days.

(21) Appl. No.: 10/674,283

(22) Filed: Sep. 29, 2003

(65) Prior Publication Data

US 2004/0131495 A1 Jul. 8, 2004

(30) Foreign Application Priority Data

Oct. 2, 2002 (JP) ..... 2002-289662

(51) Int. Cl.
*C22C 21/00* (2006.01)

(52) U.S. Cl. ..... 148/437; 420/553; 420/551

(58) Field of Classification Search ..... 148/437, 148/438; 420/553, 551

See application file for complete search history.

(56) References Cited

U.S. PATENT DOCUMENTS 5,976,278 A * 11/1999 Sircar ..... 148/550

FOREIGN PATENT DOCUMENTS

| | | | |
|---|---|---|---|
| JP | 04285139 A | * | 10/1992 |
| JP | 2001-026831 | | 1/2001 |
| JP | 2001-026831 A | * | 1/2001 |
| JP | 2001-342532 | | 12/2001 |
| JP | 2002180171 A | * | 6/2002 |

* cited by examiner

*Primary Examiner*—Roy King
*Assistant Examiner*—Janelle Morillo
(74) *Attorney, Agent, or Firm*—Flynn, Thiel, Boutell & Tanis, P.C.

(57) ABSTRACT

An aluminum alloy piping material for automotive tubes having excellent tube expansion formability by bulge forming at the tube end and superior corrosion resistance, which is suitably used for a tube connecting an automotive radiator and heater, or for a tube connecting an evaporator, condenser, and compressor. The aluminum alloy piping material is an annealed material of an aluminum alloy containing 0.3 to 1.5% of Mn, 0.20% or less of Cu, 0.10 to 0.20% of Ti, more than 0.20% but 0.60% or less of Fe, and 0.50% or less of Si with the balance being aluminum and unavoidable impurities, wherein the aluminum alloy piping material has an average crystal grain size of 100 μm or less, and Ti-based compounds having a grain size (circle equivalent diameter, hereinafter the same) of 10 μm or more do not exist as an aggregate of two or more serial compounds in a single crystal grain.

7 Claims, 1 Drawing Sheet

ALUMINUM ALLOY PIPING MATERIAL FOR AUTOMOTIVE TUBES HAVING EXCELLENT CORROSION RESISTANCE AND FORMABILITY, AND METHOD OF MANUFACTURING SAME

BACKGROUND OF THE INVENTION

1. Field of the Invention

The present invention relates to an aluminum alloy piping material for automotive tubes. More specifically, the present invention relates to an aluminum alloy piping material for automotive tubes having an excellent corrosion resistance and formability that can be suitably used for a tube connecting an automotive radiator and heater, or for a tube connecting an evaporator, condenser, and compressor, and a method of manufacturing the same.

2. Description of Background Art

A pipe used for connecting an automotive radiator and heater or connecting an evaporator, condenser, and compressor is usually expanded at the tube end by bulge forming and connected with a radiator, heater, evaporator, condenser, or compressor. A tube connected with a radiator or the like is connected with a rubber hose and fastened by a metal band. Conventionally, a single pipe made of an Al—Mn alloy such as AA3003 alloy or a two-layer or three-layer clad pipe in which an Al—Mn alloy as a core material is clad with a sacrificial anode material made of an Al—Zn alloy such as AA7072 alloy is used as a piping material.

A piping material made of an Al—Mn alloy tends to develop pitting corrosion or intergranular corrosion when used under severe conditions. When such a piping material is connected with a rubber hose, crevice corrosion occurs underneath the rubber hose, i.e. on the outer surface of the piping material. Occurrence of pitting corrosion and crevice corrosion can be prevented by using a clad pipe. However, such a measure has the drawback of bringing about a substantial cost increase.

As a solution for the above-described problems, there has been proposed a piping material in which Cu and Ti are added to an Al—Mn alloy, while limiting the Fe and Si content to specific ranges so that the alloy has improved crevice corrosion resistance (Japanese Patent Application Laid-open No. 4-285139). This piping material demonstrated satisfactory characteristics under various use conditions. However, this piping material occasionally suffered from insufficient formability in bulge forming of the tube end, or encountered a problem relating to corrosion resistance when exposed to a severe corrosive environment.

The present inventors have, in the course of research to elucidate the problems of insufficient formability and corrosion resistance exhibited by the above Al—Mn alloy piping materials, found that the reduced corrosion resistance is caused by microgalvanic_corrosion_occurring_between the alloy matrix_and various intermetallic compounds existing in the matrix, and also that the dispersion condition of intermetallic compounds affects the formability of the tube end. Based on the above findings, the present inventors have proposed an aluminum alloy as a piping material having excellent corrosion resistance and formability, such an aluminum alloy comprising, in mass percent, 0.3 to 1.5% of Mn, 0.20% or less of Cu, 0.06 to 0.30% of Ti, 0.01 to 0.20% of Fe, and 0.01 to 0.20% of Si with the balance being aluminum and unavoidable impurities, characterized in that, of the Si-based compounds, Fe-based compounds, and Mnbased compounds existing in the matrix, the number of compounds having a diameter of 0.5 μm or more is $2\times10^4$ or less per square millimeter (Japanese Patent Application Laid-open No. 2002-180171).

However, the aluminum alloy piping material described in Japanese Patent Application Laid-open No. 2002-180171 still produces occasional cracking at the tube end when the tube end is expanded by bulge forming in actual applications. Therefore, the present inventors have conducted further experiments and studies in an attempt to resolve such problems, and have found that cracking at the tube end is ascribable to an aggregate of Ti-based compounds formed in the alloy matrix and acting as a starting point of the cracks.

The present invention has been made based on the above findings, and an object of the invention is to provide an aluminum alloy piping material for automotive tubes having better formability than the material offered in Japanese Patent Application Laid-open No. 2002-180171 as well as superior corrosion resistance under a severe corrosive environment, and a method of manufacturing the same.

SUMMARY OF THE INVENTION

In order to achieve the above object, the present invention provides an aluminum alloy piping material for automotive tubes having excellent corrosion resistance and formability, which is an annealed material of an aluminum alloy comprising, in mass percent (hereinafter the same), 0.3 to 1.5% of Mn, 0.20% or less of Cu, 0.10 to 0.20% of Ti, more than 0.20% but 0.60% or less of Fe, and 0.50% or less of Si with the balance being aluminum and unavoidable impurities, wherein the aluminum alloy piping material has an average crystal grain size of 100 μm or less, and Ti-based compounds having a grain size (circle equivalent diameter, hereinafter the same) of 10 μm or more do not exist as an aggregate of two or more serial compounds in a single crystal grain.

In this aluminum alloy piping material for automotive tubes having excellent corrosion resistance and formability, the aluminum alloy may further comprise 0.4% or less of Mg.

In this aluminum alloy piping material for automotive tubes having excellent corrosion resistance and formability, the aluminum alloy may further comprise at least one of 0.01 to 0.2% of Cr and 0.01 to 0.2% of Zr.

In this aluminum alloy piping material for automotive tubes having excellent corrosion resistance and formability, the aluminum alloy may further comprise at least one of 0.01 to 0.1% of Zn, 0.001 to 0.05% of In, and 0.001 to 0.05% of Sn.

The present invention also provides a method of manufacturing an aluminum alloy piping material for automotive tubes having excellent corrosion resistance and formability, the method comprising hot extruding a billet of the above aluminum alloy into an aluminum alloy tube, cold drawing the aluminum alloy tube, and annealing the cold-drawn product, wherein a reduction ratio of the cold drawing is 30% or more, a total reduction ratio of the hot extrusion and the cold drawing is 99% or more, and a temperature increase rate during the annealing is 200° C./h or more, the reduction ratio being expressed by {(cross-sectional area before forming−cross-sectional area after forming)/(cross-sectional area before forming)}×100%.

Other objects, features and advantages of the invention will hereinafter become more readily apparent from the following description.

DETAILED DESCRIPTION OF THE INVENTION AND PREFERRED EMBODIMENT

Figure 1:
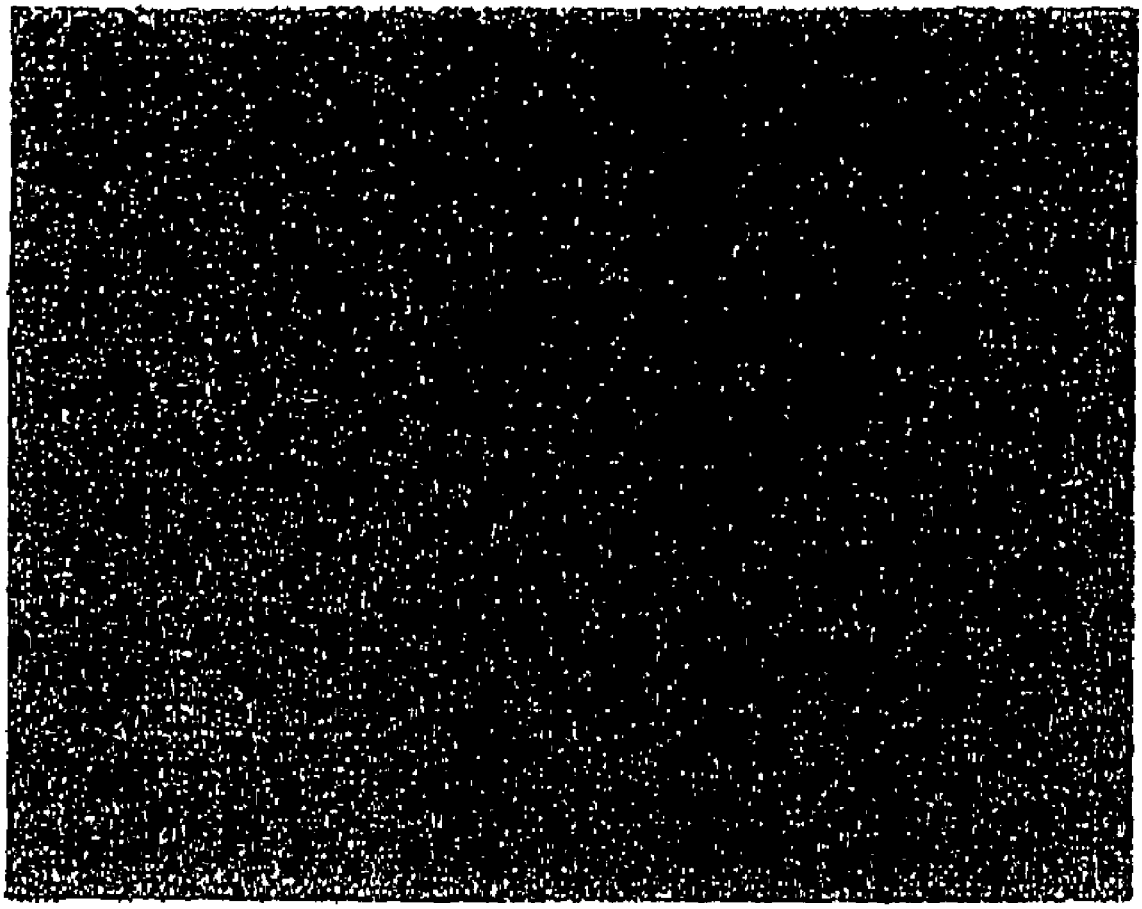
FIG. 1 is a micrograph showing an example of a series of Ti-based compounds at 100 magnification.

The significance and reasons for the limitations of the alloying components in the aluminum alloy piping material for automotive tubes having excellent corrosion resistance and formability_according_to_the_present invention_are_described_below. Mn functions to increase the strength and improve_the_corrosion resistance, in particular, pitting corrosion resistance, of the aluminum alloy. The preferred range for the Mn content is 0.3 to 1.5%. If the Mn content is less than 0.3%, the improvement effect will become insufficient. If the Mn content exceeds 1.5%, the corrosion resistance is reduced due to the formation of a multitude of Mn-based compound grains. The more preferred range for the Mn content is 0.8% or more and less than 1.2%.

Cu functions to improve the strength of the alloy. The preferred Cu content is in the range of 0.20% or less (excluding 0%). If the Cu content exceeds 0.20%, the corrosion resistance is reduced. The more preferred range for the Cu content is 0.05 to 0.10%.

Ti exists in two types of regions, i.e., one that contains a high concentration of Ti and the other with a lower Ti concentration, which are distributed as alternate layers in the thickness-wise direction. Since the region with a lower Ti concentration corrodes in preference to the region with a higher Ti concentration, the resultant corrosion takes a stratified form where the development of corrosion in the thickness-wise direction is hindered, thereby contributing to an improvement in pitting corrosion resistance, intergranular corrosion resistance, and crevice corrosion resistance. The preferred Ti content is in the range of 0.10 to 0.20%. If the Ti content is less than 0.10%, the improvement effect is insufficient. If the Ti content exceeds 0.20%, coarse compounds are formed in large quantities, making the piping material prone to crack at the time of expansion work.

Fe reduces the crystal grain size after annealing. The preferred content of Fe is in the range above 0.20% but not more than 0.60%. If the Fe content is 0.20% or less, the effect is insufficient. If the Fe content exceeds 0.60%, a large quantity of Fe-based compound grains are formed, resulting in a reduced corrosion resistance.

Si, as is the case with Fe, reduces the crystal grain size after annealing. The preferred content of Si is 0.50% or less (excluding 0%). If the Si content exceeds 0.50%, grains of Si-based compounds are formed in large quantities to cause the corrosion resistance to deteriorate.

Mg acts to improve the strength and reduce the crystal grain size. The preferred content of Mg is 0.4% or less (excluding 0%). If the Mg content exceeds 0.4%, it gives rise to insufficient extrudability as well as a reduced corrosion resistance. The more preferred range for the Mg content is 0.20% or less.

Cr and Zr, similarly with Ti, exist in two types of regions, i.e., one that contains high concentrations of these elements and the other with lower concentrations, which are distributed as alternate layers in the thickness-wise direction. Since the regions with lower concentrations of Cr and Zr corrode in preference to those with higher concentrations, the resultant corrosion takes a stratified form where the development of corrosion in the thickness-wise direction is hindered, thereby contributing to improvements in pitting corrosion resistance, intergranular corrosion resistance, and crevice corrosion resistance. The preferred content of Cr and Zr is in the ranges of 0.01 to 0.2% for Cr and 0.01 to 0.2% for Zr. At concentration levels below the specified_minimum, the_improvement_effect_becomes insufficient. If_these_elements_are_above_the_specified maximum, coarse_compounds are formed during casting, making the piping material prone to cracking at the time of expansion work.

Zn, In, and Sn act to modify this form of corrosion into a uniform corrosion type, thereby inhibiting the development of pitting corrosion in the thickness-wise direction. The preferred content for Zn, In, and Sn is in the ranges of 0.01 to 0.1% for Zn, 0.001 to 0.05% for In, and 0.001 to 0.05% for Sn, respectively. At concentration levels below the specified minimum, the improvement effect becomes insufficient. If these elements are above the specified maximum, the corrosion resistance is reduced.

It is important for the aluminum alloy piping material of the present invention that the average crystal grain size be 10 μm or less, and that Ti-based compounds having a grain size (circle equivalent diameter) of 10 μm or more do not exist as an aggregate of two or more serial compounds in a single crystal grain. If the average grain size exceeds 100 μm, elongation and deformation of the piping material become uneven at the time of expansion work, making the material prone to develop an orange peel surface or cracks. Even if the average grain size is 100 μm or less, if Ti-based compounds having a grain size of 10 μm or more exist as an aggregate of two or more serial compounds in a single alloy crystal grain as shown in FIG. 1, stress concentrates during expansion work, whereby cracks occur from the Ti-based compounds.

The aluminum alloy piping material for automotive tubes according to the present invention is manufactured by casting a molten alloy metal having the above composition into a billet by continuous casting (semi-continuous casting), providing the billet with a homogenization treatment, and forming the homogenized billet into a tubular shape by hot extrusion, cold drawing the hot-extruded product, and annealing the resulting product to obtain an 0 temper.

In the present invention, it is preferable that in the above manufacturing steps, the reduction ratio of cold drawing be 30% or more, the total reduction ratio of hot extrusion and cold drawing be 99% or more, and the temperature increase rate during annealing be 200° C./h or more. The reduction ratio is expressed by {(cross-sectional_area_before_forming~cross-sectional_area fter forming)/(cross-sectional area before forming)}×100%.

If the reduction ratio of cold drawing is less than 30%, the crystal grain size after annealing will become coarse, allowing Ti-based compounds to exist as an aggregate of two or more serial compounds in a single crystal grain, thereby making the material prone to develop cracks at the time of expansion work. If the total reduction ratio of hot extrusion and cold drawing is less than 99%, since the Ti-based compounds formed during casting are not adequately dispersed and tend to exist at one location, cracks develop at the time of expansion work.

The smaller the temperature increase rate applied during annealing, the larger the crystal grain size after annealing, allowing Ti-based compounds to exist as an aggregate of two or more serial compounds in a single crystal grain, thereby making the material prone to cracking at the time of expansion work. In particular, in the case where the aluminum alloy piping material after cold drawing is annealed in a coil-like shape, bringing the temperature increase rate to a sufficiently high level results in a substantial cost increase.

The present invention, however, makes it possible to obtain fine crystal grains by setting the temperature increase rate to 200° C./h or more.

EXAMPLES

In the following sections, the present invention will be explained in more detail referring to the Examples and Comparative Examples. However, the present invention should not be construed to be limited thereto since the Examples set forth are intended to merely illustrate preferred embodiments.

Example 1

Aluminum alloys having compositions as shown in Tables 1 and 2 were made into billets measuring 100 mm in diameter by semi-continuous casting followed by a homogenization treatment. Subsequently, the billets were worked by hot extrusion to form extruded tubes measuring 40 mm in outer diameter and 3 mm in thickness, which were then cold drawn into tubes measuring 18 mm in outer diameter and 1 mm in thickness. Then, an annealing treatment_was_provided_by heating_the_tubes_to__450° C._at_a_temperature increase rate of 300° C./h. The reduction ratio of cold drawing and the total reduction ratio of hot extrusion and cold drawing were 84.7% and 99.3%, respectively.

Mechanical characteristics of the tubes (specimens) after annealing were measured, and the average grain size (μm) at the outer circumferential surface of the specimens was measured according to the comparison method as specified in ASTM-E112. The specimens were tested For the distribution pattern of Ti-based compounds and evaluated for bulge formability and corrosion resistance according to the following methods. The results of these tests and measurements are summarized in Tables 3 and 4.

Distribution Pattern of Ti-based Compounds:

10 images of optical micrographs of the subject structure that were enlarged 100 times (total area: 0.2 $mm^2$) were inspected for the largest number of Ti-based compounds having a grain size (circle equivalent diameter) of 10 μm or more recognizable in a single crystal grain.

Bulge Formability:

Bulge forming was provided at the tube end which was then inspected for the presence or absence of orange peel surface. Specimens showing no signs of orange peel surface were judged as having good bulge formability (marked with "○"), whereas specimens showing either orange peel surface or cracks were judged as having poor bulge formability (marked with "X").

Corrosion Resistance:

The CASS test was conducted for the outer surface of the specimen tube for 672 hours, and the largest depth of pitting corrosion observed on the outer surface of the specimen tube was measured.

TABLE 1

| | Composition (mass %) | | | | | | |
|---|---|---|---|---|---|---|---|
| Alloy | Si | Fe | Mn | Cu | Ti | Mg | Other |
| 1 | 0.15 | 0.45 | 1.20 | 0.05 | 0.16 | — | |
| 2 | 0.10 | 0.30 | 1.00 | 0.10 | 0.16 | — | |
| 3 | 0.10 | 0.30 | 0.40 | 0.10 | 0.15 | — | |

TABLE 1-continued

| | Composition (mass %) | | | | | | |
|---|---|---|---|---|---|---|---|
| Alloy | Si | Fe | Mn | Cu | Ti | Mg | Other |
| 4 | 0.10 | 0.30 | 1.40 | 0.10 | 0.16 | — | |
| 5 | 0.10 | 0.30 | 1.00 | 0.00 | 0.15 | 0.10 | |
| 6 | 0.10 | 0.30 | 1.00 | 0.19 | 0.16 | — | |
| 7 | 0.10 | 0.30 | 1.00 | 0.10 | 0.10 | — | |
| 8 | 0.10 | 0.30 | 1.00 | 0.10 | 0.18 | — | |
| 9 | 0.10 | 0.22 | 1.00 | 0.10 | 0.16 | 0.20 | |
| 10 | 0.10 | 0.58 | 1.00 | 0.10 | 0.16 | — | |
| 11 | 0.02 | 0.30 | 1.00 | 0.10 | 0.16 | 0.20 | |
| 12 | 0.48 | 0.30 | 1.00 | 0.10 | 0.16 | — | |
| 13 | 0.10 | 0.30 | 1.00 | 0.10 | 0.16 | 0.38 | |
| 14 | 0.10 | 0.30 | 1.00 | 0.10 | 0.16 | — | Zn 0.03 |
| 15 | 0.10 | 0.30 | 1.00 | 0.10 | 0.16 | 0.10 | In 0.01 |
| 16 | 0.10 | 0.30 | 1.00 | 0.10 | 0.16 | 0.20 | Sn 0.01 |
| 17 | 0.10 | 0.30 | 1.00 | 0.10 | 0.16 | — | Zn 0.09 |
| 18 | 0.10 | 0.30 | 1.00 | 0.10 | 0.16 | 0.20 | In 0.05 |
| 19 | 0.10 | 0.30 | 1.00 | 0.10 | 0.16 | — | Sn 0.05 |
| 20 | 0.10 | 0.30 | 1.00 | 0.10 | 0.16 | — | Cr 0.03 |

TABLE 2

| | Composition (mass %) | | | | | | |
|---|---|---|---|---|---|---|---|
| Alloy | Si | Fe | Mn | Cu | Ti | Mg | Other |
| 21 | 0.10 | 0.30 | 1.00 | 0.10 | 0.16 | — | Zn 0.03 |
| 22 | 0.10 | 0.30 | 1.00 | 0.10 | 0.16 | — | Cr 0.18 |
| 23 | 0.10 | 0.30 | 1.00 | 0.10 | 0.16 | — | Zr 0.18 |
| 24 | 0.10 | 0.30 | 1.00 | 0.10 | 0.16 | — | Zn 0.03 In 0.01 |
| 25 | 0.10 | 0.30 | 1.00 | 0.10 | 0.16 | — | Zn 0.03 Cr 0.01 |
| 26 | 0.10 | 0.30 | 1.00 | 0.10 | 0.16 | — | In 0.01 Cr 0.01 |
| 27 | 0.10 | 0.30 | 1.00 | 0.10 | 0.16 | — | In 0.01 Zr 0.01 |
| 28 | 0.10 | 0.30 | 1.00 | 0.10 | 0.16 | — | Zn 0.03 Zr 0.01 |
| 29 | 0.10 | 0.30 | 1.00 | 0.10 | 0.16 | — | Sn 0.01 Cr 0.02 |

TABLE 3

| Specimen | Alloy | Tensile strength (Mpa) | Average crystal grain size (μm) | Ti-based compound distribution (number) | Bulge formability | Maximum Corrosion depth (mm) |
|---|---|---|---|---|---|---|
| 1 | 1 | 110 | 35 | 0 | ○ | 0.45 |
| 2 | 2 | 109 | 50 | 1 | ○ | 0.38 |
| 3 | 3 | 75 | 50 | 0 | ○ | 0.38 |
| 4 | 4 | 120 | 50 | 0 | ○ | 0.64 |
| 5 | 5 | 120 | 50 | 0 | ○ | 0.20 |
| 6 | 6 | 122 | 50 | 1 | ○ | 0.71 |
| 7 | 7 | 110 | 50 | 0 | ○ | 0.62 |
| 8 | 8 | 110 | 50 | 1 | ○ | 0.35 |
| 9 | 9 | 107 | 80 | 0 | ○ | 0.25 |
| 10 | 10 | 113 | 30 | 1 | ○ | 0.70 |
| 11 | 11 | 107 | 60 | 0 | ○ | 0.40 |
| 12 | 12 | 112 | 40 | 0 | ○ | 0.52 |
| 13 | 13 | 125 | 50 | 1 | ○ | 0.38 |
| 14 | 14 | 112 | 50 | 0 | ○ | 0.35 |
| 15 | 15 | 110 | 50 | 0 | ○ | 0.39 |
| 16 | 16 | 112 | 50 | 0 | ○ | 0.42 |
| 17 | 17 | 110 | 50 | 0 | ○ | 0.52 |
| 18 | 18 | 109 | 50 | 1 | ○ | 0.60 |
| 19 | 19 | 109 | 50 | 0 | ○ | 0.58 |
| 20 | 20 | 110 | 50 | 0 | ○ | 0.42 |

<Note>
Ti-based compound distribution: Largest number of Ti-based compounds found in a single alloy crystal grain

TABLE 4

| Specimen | Alloy | Tensile strength (Mpa) | Average crystal grain size (μm) | Ti-based compound distribution (number) | Bulge formability | Maximum Corrosion depth (mm) |
|---|---|---|---|---|---|---|
| 21 | 21 | 108 | 50 | 1 | ○ | 0.38 |
| 22 | 22 | 110 | 50 | 0 | ○ | 0.58 |
| 23 | 23 | 113 | 50 | 0 | ○ | 0.58 |
| 24 | 24 | 112 | 50 | 0 | ○ | 0.50 |
| 25 | 25 | 110 | 50 | 0 | ○ | 0.45 |
| 26 | 26 | 110 | 50 | 1 | ○ | 0.45 |
| 27 | 27 | 110 | 50 | 0 | ○ | 0.36 |
| 28 | 28 | 111 | 50 | 0 | ○ | 0.45 |
| 29 | 29 | 111 | 50 | 0 | ○ | 0.47 |

As can be seen in Tables 3 and 4, all of the Specimens No. 1 to No. 29_prepared_according_to_the_present invention demonstrated a good tensile strength of 70 to 140 MPa, average grain size of 100 μm or less, and a good bulge formability. Moreover, the maximum corrosion depth observed for each specimen was less than 0.80 mm, indicating that the specimens possessed a good corrosion resistance. All the specimens prepared according to the present invention demonstrated good extrudability causing no problems during the manufacturing process and enabling the production of sound test pieces.

Comparative Example 1

Aluminum alloys having the compositions as shown in Table 5 were made into billets measuring 100 mm in diameter by semi-continuous casting followed by a homogenization treatment. Subsequently, the billets were worked by hot extrusion to form extruded tubes measuring 40 mm in outer diameter and 3 mm in thickness, which were then cold drawn into tubes measuring 18 mm in outer diameter and 1 mm in thickness. Then, an annealing treatment was provided by heating the tubes to 450° C. at a temperature increase rate of 300° C./h. The reduction ratio of cold drawing and the total reduction ratio of hot extrusion and cold drawing were 84.7% and 99.3%, respectively.

For the tubes (specimens) after annealing, measurements were given for mechanical characteristics as well as the average grain size at the outer circumferential surface by following the same procedures as in Example 1. The specimens were tested for the distribution pattern of Ti-based compounds and evaluated for bulge formability and corrosion resistance. The results of these tests and measurements are summarized in Table 6. In Tables 5 and 6, conditions_outside_of the provisions_of_the_present_invention are underlined.

TABLE 5

| | Compositions (mass %) | | | | | | |
|---|---|---|---|---|---|---|---|
| Alloy | Si | Fe | Mn | Cu | Ti | Mg | Others |
| 34 | 0.10 | 0.30 | 0.20 | 0.10 | 0.16 | — | |
| 35 | 0.10 | 0.30 | 1.60 | 0.10 | 0.16 | 0.20 | |
| 36 | 0.10 | 0.30 | 1.00 | 0.30 | 0.16 | — | |
| 37 | 0.10 | 0.30 | 1.00 | 0.10 | 0.08 | — | |
| 38 | 0.10 | 0.30 | 1.00 | 0.00 | 0.22 | — | |
| 39 | 0.10 | 0.10 | 1.00 | 0.19 | 0.16 | 0.20 | |
| 40 | 0.10 | 0.80 | 1.00 | 0.10 | 0.16 | — | |
| 41 | 0.70 | 0.30 | 1.00 | 0.10 | 0.16 | — | |
| 42 | 0.10 | 0.22 | 1.00 | 0.10 | 0.16 | 0.60 | |

TABLE 5-continued

| | Compositions (mass %) | | | | | | |
|---|---|---|---|---|---|---|---|
| Alloy | Si | Fe | Mn | Cu | Ti | Mg | Others |
| 43 | 0.10 | 0.58 | 1.00 | 0.10 | 0.16 | — | Zn 0.3 |
| 44 | 0.02 | 0.30 | 1.00 | 0.10 | 0.16 | — | In 0.1 |
| 45 | 0.48 | 0.30 | 1.00 | 0.10 | 0.16 | 0.10 | Sn 0.1 |
| 46 | 0.10 | 0.30 | 1.00 | 0.10 | 0.16 | 0.10 | Cr 0.4 |
| 47 | 0.10 | 0.30 | 1.00 | 0.10 | 0.16 | — | Zn 0.4 |
| 48 | 0.25 | 0.45 | 1.20 | 0.15 | 0.00 | — | |
| 49 | 0.10 | 0.80 | 1.00 | 0.30 | 0.22 | — | |

TABLE 6

| Specimen | Alloy | Tensile strength (Mpa) | Average grain size (μm) | Ti-based compound distribution (number) | Bulge formability | Maximum corrosion depth (mm) |
|---|---|---|---|---|---|---|
| 34 | 34 | 68 | 40 | 0 | ○ | 0.37 |
| 35 | 35 | 125 | 40 | 1 | ○ | 0.86 |
| 36 | 36 | 133 | 40 | 0 | ○ | 1.00 |
| 37 | 37 | 110 | 40 | 0 | ○ | 0.87 |
| 38 | 38 | 110 | 40 | 3 | X | 0.38 |
| 39 | 39 | 107 | 120 | 2 | X | 0.35 |
| 40 | 40 | 118 | 25 | 0 | ○ | 0.90 |
| 41 | 41 | 120 | 30 | 0 | ○ | 0.88 |
| 42 | 42 | — | — | — | — | — |
| 43 | 43 | 109 | 40 | 0 | ○ | >1 (Pierced) |
| 44 | 44 | 111 | 40 | 0 | ○ | 0.91 |
| 45 | 45 | 111 | 40 | 1 | ○ | 0.82 |
| 46 | 46 | 113 | 40 | 0 | X | 0.90 |
| 47 | 47 | 110 | 40 | 0 | X | 0.86 |
| 48 | 48 | 112 | 40 | 0 | ○ | >1 (Pierced) |
| 49 | 49 | 135 | 30 | 2 | X | 0.90 |

From Table 6, it can be seen that Specimen No. 34, due to its insufficient Mn content, exhibited an inferior strength. Specimen No. 35, with too high a Mn content, formed an excessive quantity of Mn-based compounds to exhibit poor corrosion resistance. Specimen No. 36, due to its excessive Cu content, exhibited inferior corrosion resistance.

Specimen No. 37, due to its low Ti content, exhibited an inferior corrosion resistance. Specimen No. 38 with an excessive Ti content suffered from an inferior formability and therefore poor bulge formability, as a result of the formation of coarse compounds during casting. Specimen No. 39, due to its low Fe content, resulted in too large an average grain size and developed an orange peel surface during bulge forming. Specimen No. 40, with an excessive Fe content, formed a large quantity of Fe-based compounds to result in an inferior corrosion resistance.

Specimen No. 41, due to its excessive Si content, exhibited inferior corrosion resistance. Specimen No. 42 suffered from reduced extrudability because of its excessive Mg content and failed to produce a sound test piece. In all cases of Specimen Nos. 43, 44, and 45, poor corrosion resistance was exhibited because of the excessive presence of either Zn, In, or Sn, respectively.

In either of Specimen No. 46 and Specimen No. 47, since these Specimens contained an excessive amount of Cr and Zr, respectively, coarse compounds were formed during casting, thereby_reducing_formability_to_ cause_orange_peel_surface or cracks to develop at the time of bulge forming. Specimen No. 48 was based on a conventional AA3003 alloy and showed inferior corrosion resistance. Specimen No. 49 contained excessive amounts of Fe, Cu, and Ti to result in inferior quality both in terms of corrosion resistance and bulge formability.

Example 2 and Comparative Example 2

An aluminum alloy containing 0.10% of Si, 0.30% of Fe, 1.00% of Mn, 0.10% of Cu, and 0.16% of Ti, with the balance being aluminum and unavoidable impurities was cast into billets measuring 60 to 200 mm in diameter by semi-continuous casting, followed by a homogenization treatment. Subsequently, the billets were worked by hot extrusion to form extruded tubes measuring 20 to 40 mm in outer diameter and 1.2 to 3 mm in thickness, which were then cold drawn into tubes measuring 8 to 18 mm in outer diameter and 1 mm in thickness. Then, an annealing treatment was provided by heating the tubes to 450° C. at varying temperature increase rates of 100 to 1,000° C./h.

For the tubes (specimens) after annealing, measurements were given for mechanical characteristics as well as the average grain size at the outer circumferential surface of the specimens by following the same procedures as in Example 1. The specimens were tested for the distribution pattern of Ti-based compounds and evaluated for bulge formability and corrosion resistance. Table 7 summarizes billet diameters, extruded tube dimensions, drawn tube dimensions, reduction ratios of cold drawing, and total reduction_ratios_of_hot extrusion_and_cold_drawing_for_each_specimen. The results of tests and measurements are summarized in Table 8. In Tables 7 and 8, conditions outside of the provisions of the present invention are underlined.

TABLE 7

| Specimen | Billet diameter (mm) | Extruded tube dimensions: Outer diameter (mm) | Extruded tube dimensions: Thickness (mm) | Drawn tube dimensions: Outer diameter (mm) | Drawn tube dimensions: Thickness (mm) | Reduction ratio of cold drawing (%) | Total reduction ratio (%) | Temperature increase rate for annealing (° C./h) |
|---|---|---|---|---|---|---|---|---|
| 30 | 200 | 40 | 3 | 18 | 1 | 84.7 | 99.8 | 300 |
| 31 | 100 | 40 | 3 | 8 | 1 | 93.7 | 99.7 | 300 |
| 32 | 100 | 20 | 2 | 18 | 1 | 52.8 | 99.3 | 300 |
| 33 | 100 | 40 | 3 | 18 | 1 | 84.7 | 99.3 | 1000 |
| 50 | 60 | 40 | 3 | 18 | 1 | 84.7 | 98.1 | 300 |
| 51 | 100 | 20 | 1.2 | 18 | 1 | 24.6 | 99.3 | 300 |
| 52 | 60 | 40 | 1.2 | 18 | 1 | 24.6 | 98.1 | 300 |
| 53 | 60 | 20 | 3 | 18 | 1 | 84.7 | 98.1 | 100 |

TABLE 8

| Specimen | Tensile strength (MPa) | Average grain size (μm) | Ti-based compound distribution (number) | Bulge formability | Maximum corrosion depth (mm) |
|---|---|---|---|---|---|
| 30 | 109 | 50 | 1 | ○ | 0.45 |
| 31 | 111 | 40 | 0 | ○ | 0.48 |
| 32 | 110 | 70 | 0 | ○ | 0.43 |
| 33 | 110 | 35 | 0 | ○ | 0.41 |
| 50 | 110 | 60 | 2 | X | 0.43 |
| 51 | 107 | 110 | 2 | X | 0.47 |
| 52 | 108 | 120 | 4 | X | 0.41 |
| 53 | 107 | 120 | 2 | X | 0.38 |

As can be seen in Table 8, all of the Specimens No. 30 to No. 33 prepared according to the present invention demonstrated good tensile strength of 70 to 130 MPa, average grain sizes of less than 100 μm, and good bulge formability. Moreover, the maximum corrosion depth observed for each specimen was less than 0.80 mm, indicating that the specimens possessed good corrosion resistance. All the specimens prepared according to the present invention demonstrated good extrudability causing no problems during the manufacturing process and enabling production of sound test pieces.

By contrast, since Specimen No. 50 was prepared with an insufficient total reduction ratio of hot extrusion and cold drawing, which prevented Ti-based compounds formed during casting from being adequately dispersed, formability of the material became inferior, causing cracks to develop during bulge forming. Since the reduction ratio of cold drawing was insufficient in the case of Specimen No. 51, and the reduction ratio of cold drawing and the total reduction ratio were insufficient in the case of Specimen No. 52, both specimens formed coarse crystal grains, causing cracks to develop during bulge forming. Specimen No. 53, due to its insufficient temperature increase rate during annealing, formed coarse crystal grains, causing cracks to develop during bulge forming.

According to the present invention, an aluminum alloy piping material for automotive tubes having an excellent tube expansion formability_by_bulge_forming_at_the_tube_end_and superior_corrosion resistance to withstand a severe corrosive environment, and a method_of_manufacturing_the_same are provided. This aluminum_alloy piping material for automotive tubes is suitably used for a tube connecting an automotive radiator and heater, or for a tube connecting an evaporator, condenser, and compressor.

Obviously, numerous modifications and variations of the present invention are possible in light of the above teachings. It is therefore to be understood that, within the scope of the appended claims, the invention may be practiced otherwise than as specifically described herein.

What is claimed is:

1. An aluminum alloy piping material for automotive tubes having excellent corrosion resistance and formability and which is an annealed material of an aluminum alloy comprising, in mass percent, 0.8 to 1.5% of Mn, 0.05% or less of Cu, 0.10 to 0.20% of Ti, 0.30% to 0.60% of Fe, and 0.50% or less of Si with the balance being aluminum and unavoidable impurities, wherein the aluminum alloy piping material has an average crystal grain size of 100 μm or less, and Ti-based compounds having a grain size of 10 μm or more do not exist as an aggregate of two or more serial compounds in a single crystal grain, wherein the aluminum alloy is hot-extruded and cold-drawn at a reduction ratio of 30% or more, the total reduction ratio of hot extrusion and cold drawing is 99% or more and the temperature increase rate during annealing is 200° C./h or more.

2. The aluminum alloy piping material according to claim 1, wherein the aluminum alloy further comprises up to 0.4% of Mg.

3. The aluminum alloy piping material according to claim 1, wherein the aluminum alloy further comprises at least one of 0.01 to 0.2% of Cr and 0.01 to 0.2% of Zr.

4. The aluminum alloy piping material according to claim 1, wherein the aluminum alloy further comprises at least one of 0.01 to 0.1% of Zn, 0.001 to 0.05% of In, and 0.001 to 0.05% of Sn.

5. A method of manufacturing an aluminum alloy piping material for automotive tubes having excellent corrosion resistance and formability, the method comprising hot extruding a billet of the aluminum alloy according to claim 1 into an aluminum alloy tube, cold drawing the aluminum alloy tube, and annealing the cold-drawn product, wherein a reduction ratio of the cold drawing is 30% or more, a total reduction ratio of the hot extrusion and the cold drawing is 99% or more, and a temperature increase rate during the annealing is 200° C./h or more, the reduction ratio being expressed by {(cross-sectional area before forming—cross-sectional area after forming)/(cross-sectional area before forming)}×100%.

6. The aluminum alloy piping material according to claim 1, wherein at least 0.22% Fe is present.

7. The aluminum alloy piping material according to claim 1, wherein at least 0.30% Fe is present.

* * * * *